United States Patent [19]

Legault et al.

[11] Patent Number: 4,977,765

[45] Date of Patent: Dec. 18, 1990

[54] DELAY ACTION ELECTRONIC TIMER LOCK WITH AUTOMATIC CANCELLATION CAM

[76] Inventors: Claude Legault, 4960 Lalande, Pierrefonds, Quebec, Canada, H8Y 1V8; Pierre Deguire, 10 Lillian Way, R.R. #1, Kanata, Ontario, Canada

[21] Appl. No.: 532,899

[22] Filed: Jun. 4, 1990

[51] Int. Cl.[5] ..... E05B 43/00

[52] U.S. Cl. ..... 70/268; 70/271

[58] Field of Search ..... 70/267, 268, 269, 271, 70/270, 303 R, 303 A, 302

[56] References Cited

U.S. PATENT DOCUMENTS

| | | | |
|---|---|---|---|
| 3,391,556 | 7/1968 | Schell | 70/268 |
| 3,670,538 | 6/1972 | Curry | 70/271 |
| 3,823,586 | 7/1974 | Melancon | 70/268 |
| 4,106,316 | 8/1978 | Tippin | 70/268 |
| 4,328,689 | 5/1982 | Keller | 70/269 |
| 4,843,850 | 7/1989 | McGregor | 70/268 |

*Primary Examiner*—Robert L. Wolfe

[57] ABSTRACT

A delay action time lock having a lock housing in which a spring action bolt is movably connected. A retracting cam is provided for engagement with a bolt retracting lever for retracting a locking end of the bolt in the housing by means of a key inserted in a key cylinder and after an electronic timer has initiated a first preset time delay count. A motor actuated support cam is provided for normally supporting the retracting lever in a disengaged position with the retracting cam. After the preset time delay count, the bolt retracting lever is liberated to be engaged by the retracting cam. After a second preset time delay or upon the actuation of a microwswitch by the retracting lever, the motor actuated support cam is placed to support the retracting lever at its disengaged position so that as soon as the key cylinder is turned back to its initial position, the lock bolt is disengaged.

12 Claims, 3 Drawing Sheets

DELAY ACTION ELECTRONIC TIMER LOCK WITH AUTOMATIC CANCELLATION CAM

BACKGROUND OF INVENTION

1. Field of the Invention

The present invention relates to an improved delay action time lock and wherein an electronic timer is provided having adjustable features whereby to preset two time delay periods, the first one being actuated by turning a key cylinder or combination lock cylinder to an open position, and the second being effectuated immediately after the first time delay period is terminated or as soon as a bolt retracting lever is retracted to pull the lock bolt within the lock housing.

2. Description of Prior Art

Various delay action time locks are known effect time delay counts prior to enabling a mechanism to permit a lock to be opened. Most of these known locks utilize complex mechanical cams and levers and timers and many do not provide for an adjustment of the time period, or if they do, this adjustment is very limited. Also, these time locks are not very reliable and are difficult to repair and service. Still further, the time locks are not very precise in their time counts and this may have certain disadvantages in specific applications of the lock where very accurate time delays are required from very short periods of a few seconds to long periods of many hours.

SUMMARY OF INVENTION

It is therefore a feature of the present invention to provide an improved delay action time lock which substantially overcomes the above-mentioned disadvantages of the prior art and particularly a time lock which has an electronic timer which incorporates one or more timer modules which can be precisely set to effectuate a very accurate time delay count, and to a lock which is simple in construction, reliable, and which provides easy adjustment of the timer within a very large time scale.

Another feature of the present invention is to provide an improved delay action time lock which is easy to operate by the user and easy to service due to its modular construction.

According to the above features, from a broad aspect, the present invention provides a delay action time lock comprising a lock housing having a spring action bolt. A retracting cam is also provided and has a retracting means for engagement with a bolt retracting lever for retracting a locking end of the bolt in the housing. Retracting cam actuating means is disposed outside the housing for turning the cam. A motor actuated support cam is provided for normally supporting the bolt retracting lever in a disengaged position with the retracting cam. Switch means is associated with the retracting cam for enabling a timer circuit to initiate a first preset time delay count. An electric motor is connected to the retracting lever support cam. The timer causes the motor to be energized after the preset time delay whereby the motor will turn the support cam in a first direction to cause the retracting lever to move to an engageable position for engagement by the retracting cam. The timer circuit initiates a second preset time delay count after terminating the first count after which the motor is energized to cause the support cam to turn in a reverse direction to support the retracting lever at its disengaged position whether the retracting lever is retracted or not by the retracting cam.

BRIEF DESCRIPTION OF DRAWINGS

A preferred embodiment of the present invention will now be described with reference to the example thereof as illustrated in the accompanying drawings, in which.

DESCRIPTION OF PREFERRED EMBODIMENTS

Figure 1:
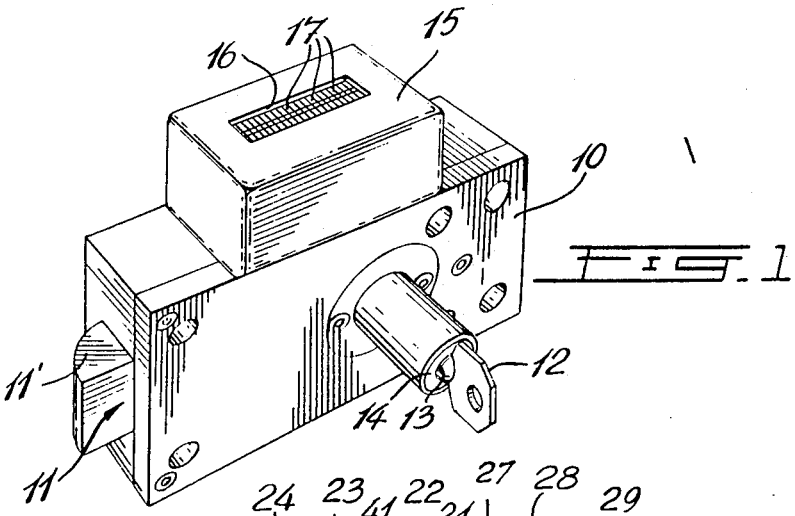
FIG. 1 is a perspective view illustrating the modular construction of the delay action time lock of the present invention with the electronic timer module removably secured to the lock housing.

Referring now to the drawings, and more particularly to FIG. 1, there is shown the delay action time lock of the present invention. This Figure illustrates the modular construction of the lock and it comprises a lock housing 10 in which is housed the locking mechanism to retract the locking end 11' of the lock bolt 11 into the housing 10 whereby to open a door (not shown) to which the lock housing is secured. The bolt end 11' is retracted by turning the key 12 which is inserted in the keyhole 13 of the lock cylinder 14. A timer housing 15 is secured to the lock housing at a convenient location and is provided with a window opening 16 in which are disposed a plurality of dip switches 17 to provide adjustment of preset time delays of the timer modules, which will be described later, provided in the electronic timer circuit.

In operation, the key 12 is inserted in the keyhole 13 and the key cylinder 14 is turned clockwise, until the key is arrested. This initiates a first preset time delay count by the timer circuit and after which time a signal, either audible or visual, is generated to indicate to the operator that the key can now be positioned to retract the bolt end 11' into the housing. As soon as the first preset time delay count is terminated, the timer circuit initiates a second time delay count and the lock bolt must be retracted by the key within that period. If not, rotation of the key 12 will not engage the necessary levers to retract the locking end 11' of the bolt within the housing. If the lock bolt is retracted, then the second count is automatically cancelled and as soon as the lock bolt is released, the key or the key cylinder is disengaged from the bolt retracting mechanism.

Figure 2:
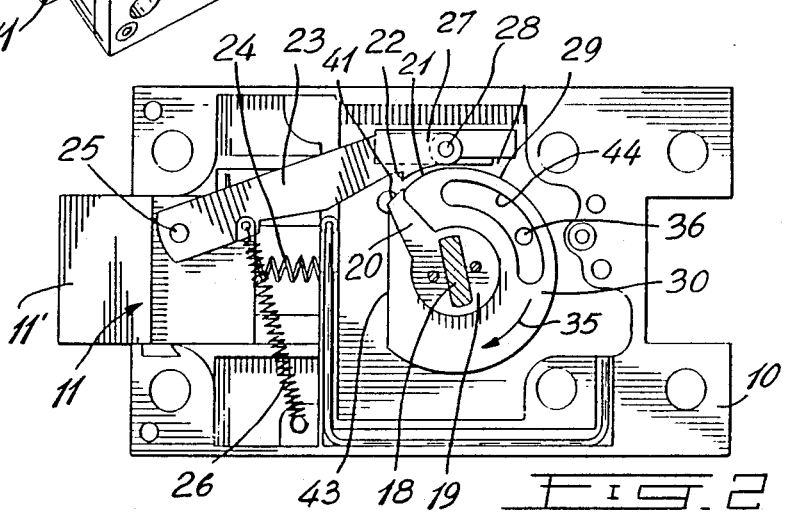
FIG. 2 is a rear view of the lock housing illustrating the main components of the delay action time lock of the present invention.

Referring now additionally to FIGS. 2 to 6, there will be described the detailed construction and operation of the delay action time lock 10. As shown in FIG. 2, the lock cylinder 14 is connected to a shaft 18 on which is secured a bolt retracting cam 19. The cam is provided with a hook member 20, formed integral therewith, and having an engaging end 21 whereby to engage with a retracting notch 22 provided in a bolt retracting lever 23 which is connected to the lock bolt 11. As herein shown, the lock bolt is a spring action lock bolt and the bolt is biased outwardly by a helical spring 24, in a manner well known in the art. The bolt retracting lever 23 is connected to the bolt 11 on a pivot pin 25. The bolt retracting lever 23 is biased downwardly by means of helical spring 26.

The free end portion 27 of the retracting lever 23 is provided with a support pin 28 extending transversely thereto (see FIG. 6) and on which a peripheral edge portion 29 of the motor actuated support cam 30 abuts whereby to displace and support the bolt retracting lever 23 at a disengaged position as shown in FIG. 2.

Referring again to FIG. 6, it can be seen that the cam engageable pin 28 has a free end 31 which is disposed in close proximity to a switch contact arm 32 of a timer cancellation switch 34 constituted by a microswitch. The free end 31 of the pin 28 is engaged in frictional contact with the switch contact arm 32 when the retracting lever 23 is retracted in the direction of arrow 33 when the lock bolt end 11' is retracted within the housing. Disengagement causes the switch contact arm 32 to effect a switch closure to cancel the second preset count of the timer.

Figure 3:
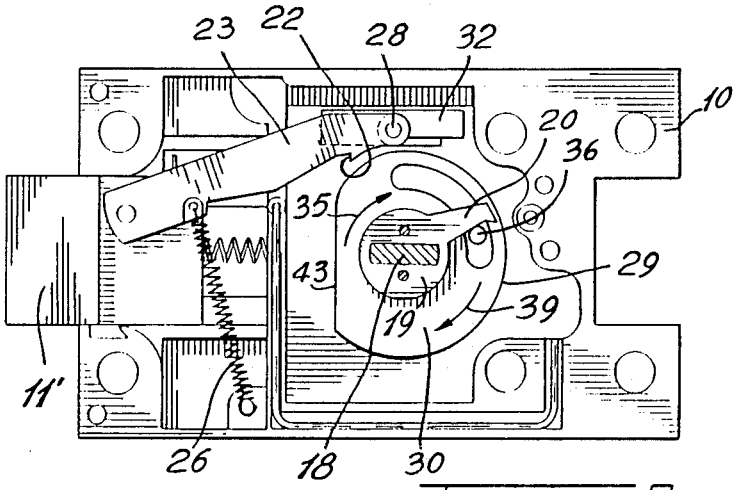
FIG. 3 is a view similar to FIG. 2 but showing the retracting cam turned to an actuating position to enable the timer circuit.
Figure 4:
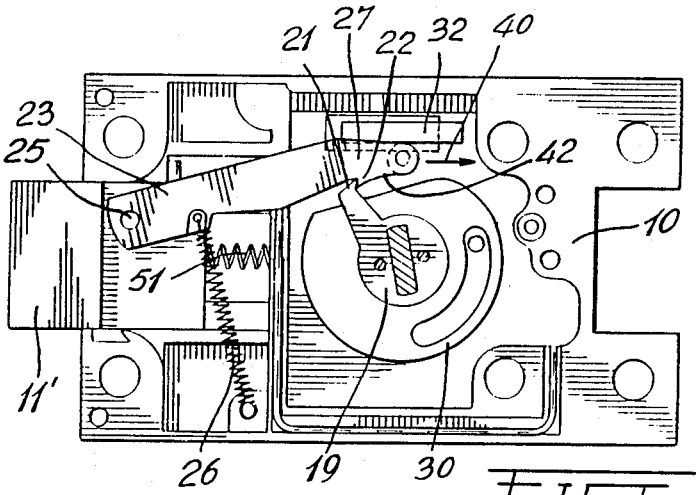
FIG. 4 is also a view similar to FIG. 2 but showing the retracting lever support cam in its disengaged position with the retracting cam engaged with the bolt retracting lever.
Figure 6:
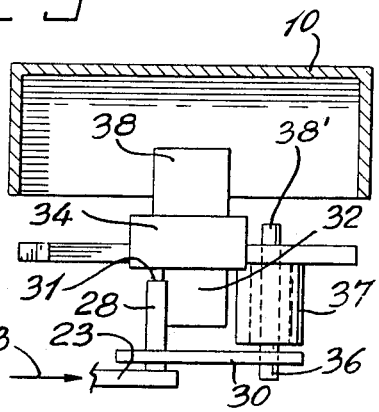
FIG. 6 is a simplified top view of the basic components of FIG. 5.

In order to initialize the timer to effect the first preset time delay count, as previously described, the key 12 is inserted into the key slot 13 and the lock cylinder 14 is rotated causing the bolt retracting cam 19 to turn in the direction of arrow 35 as shown in FIG. 3. The cylinder or key 12 is turned until it is arrested when the hook arm 20 of the cam 19 abuts with the switch contact post 36. The switch contact post 36, as shown in FIG. 6, is provided in an electrically insulating casing 37 and an insulated wire 38' is connected thereto and to the appropriate connection in the timer circuit. This contact closure initiates a first preset time delay count and after this count, an appropriate indication, either an audible or visual indication, is transmitted so that the user is now aware of the expiration of the first preset time delay count. At this time, the key 12 is turned to its initial position placing the bolt retracting cam 19 to its position as shown in FIG. 2. This retraction could have been done also immediately after the hook arm 20 has made contact with the contact pin 36. Immediately after the first preset time delay count has terminated, the timer circuit connects a six volt supply to the motor 38, which is connected to the motor actuated support cam 30, causing the cam to rotate a predetermined distance in the direction of arrow 39 (as shown in FIG. 3) whereby the cam 30 assumes its position as shown in FIG. 4, thereby disconnecting its support engagement with the support pin 28 of the bolt retracting lever 23. Accordingly, the lever drops down to its position as shown in FIG. 4 due to the pulling force exerted by the helical spring 26 and arrested at this engageable position by abutment means (not shown). The engaging end 21 of the bolt retracting cam 19 is now engageable in the notch 22 so that by turning the key 12 again in the direction of arrow 35, the retracting lever free end portion 27 is lifted upwards so that the free end 31 of the pin is aligned with the switch contact arm 32. At the same time, the free end portion of the bolt will move inwardly in the direction of arrow 40 (see FIG. 4) so as to cause the switch contact arm 32 to close and effect a switch closure to cancel the second preset time delay count.

Figure 5:
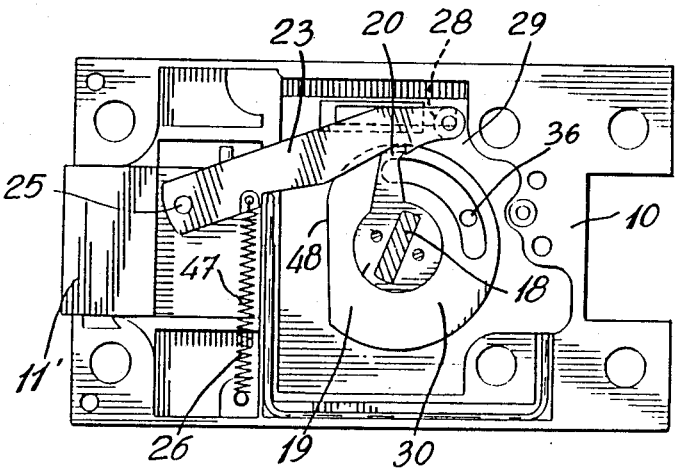
FIG. 5 is also a view similar to FIG. 2 but showing the motor actuated support cam in its position for maintaining the retracting lever in its disengaged position once released by the retracting cam.

As soon as the second preset time delay count is terminated, the motor 38 is again actuated by the timer circuit whereby to move the motor actuated support cam 30 back to its initial position, as shown in FIG. 5. Therefore, as soon as the key 12 is rotated back to its initial position, the lock bolt 11 will move out of the housing drawing the bolt retracting lever 23 to its position as shown in FIG. 2 and the support pin 28 now rests against the support peripheral edge portion 29 of the cam 30 with the retracting notch 22 positioned outside the arc of displacement of the hook member 20 and the lock bolt can no longer be retracted.

In the event that the bolt retracting cam 19 is maintained in a position engaged with the contact pin 36 during the first preset time delay count, it is pointed out that after the count is terminated, the hook member 20 can still be positioned back at its original position as shown in FIG. 2 by simply rotating it in a counterclockwise manner. Because the bolt retracting cam 19 is disposed in a common plane with the bolt retracting lever 23, when rotating the bolt retracting cam in a counter direction, the rear top edge 41 of the hook member 20 will abut against the sloped wall 42 formed on the lower edge of the free end portion 27 of the retracting lever to push the bolt slightly upwardly so that the hook member 20 can be positioned to engage the notch 22. Also, if after the expiration of the second time delay count, the key 12 has not been rotated to effect a bolt retraction, then the support cam 30 is automatically actuated by the motor 38 and this engages with the support pin 28 and pushes the bolt retracting lever 23 back to its initial disengaged position as shown in FIG. 2. It is therefore necessary to again reactivate the first preset time count of the electronic timer and wait for the delay period before the retracting lever can again be engaged.

As shown in FIGS. 2 to 5, the motor actuated support cam 30 is a disc-shaped cam which has a circular support cam portion 29 for engagement with the support pin 28 and a cut-out portion 43 to liberate the bolt retracting lever 23. The disc is also provided with a slot 44 not to interfere with the contact pin 36. A disc support cam is also offset from the plane of the bolt retracting lever 23.

Figure 7:
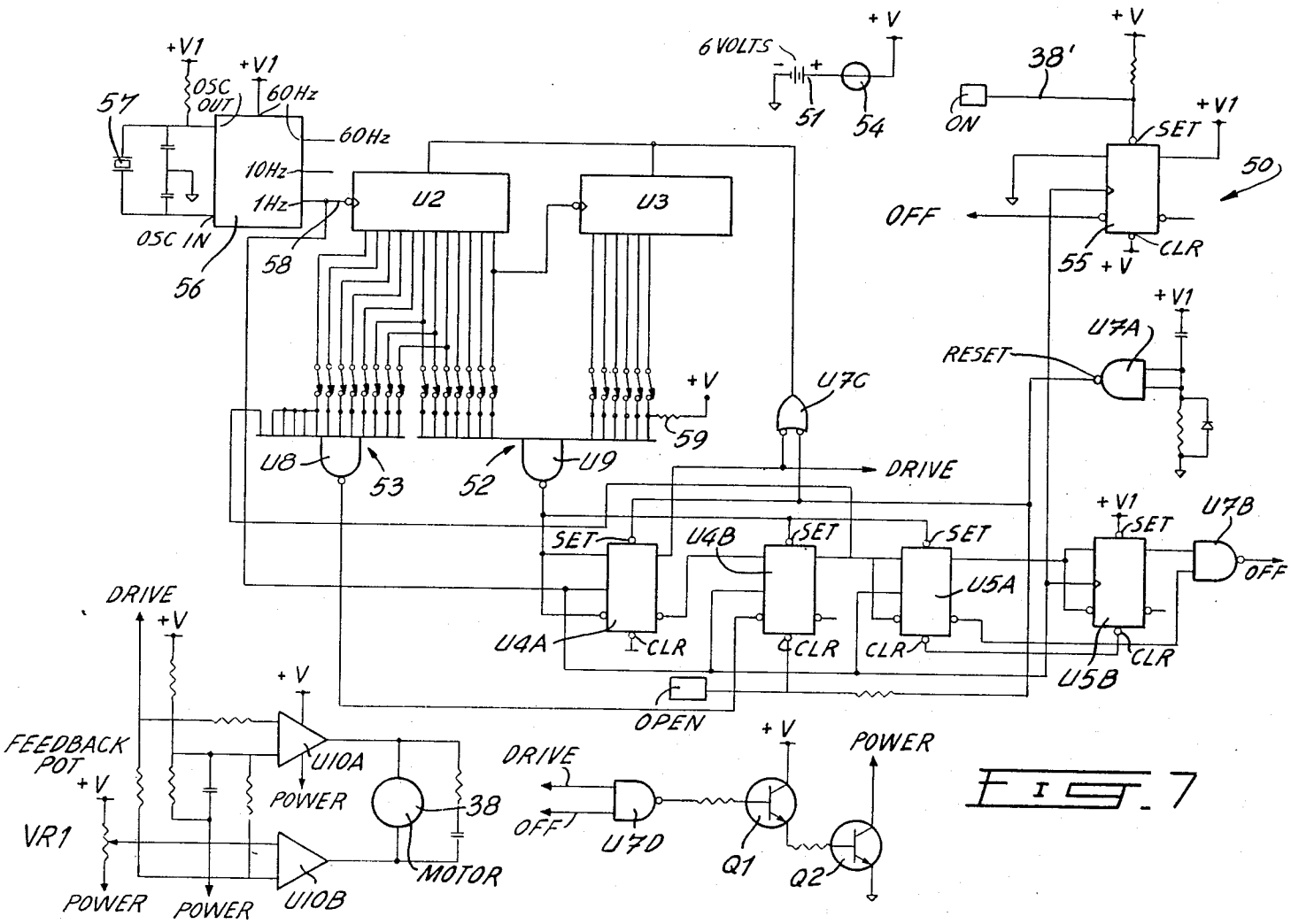
FIG. 7 is a block diagram showing the construction of the electronic timer of the present invention.

Referring now to FIG. 7, there will be briefly described the construction and operation of the timer circuit 50. The timer 50 consists of a small electronic circuit connected to the servo-motor 38 and a six-volt battery 51. It is in fact a double timer; the first one 52 controls the time until the lock is permitted to open, and the second timer 53, the time during which the lock can be opened.

Initially, the timer circuit 50 is turned on by rotating the lock key 12 clockwise and returning it to its initial position. The timer 52 starts and, at the expiration of its preset time, the motor's shaft 38. rotates by 90 degrees. This allows a door to be opened by the lock. Subsequently, the second timer 53 starts and, at the expiration of the second preset time, the motor returns to its initial position, and the timer circuit turns itself off. If, during the second preset time the door is opened by the lock, the motor 38 immediately returns to its original position and the circuit turns itself off. The timer is then ready for another cycle. The timers 52 and 53 are fully adjustable, anywhere from seconds to days. The accuracy of the timer is excellent, with less than 10 seconds of error per day.

As shown in FIG. 7, the timer circuit 50 has two sections: the first section consisting of the supply and protection diode 54 and a flip-flop circuit 55 which is continuously powered from the six-volt battery. The second one, the timer per se, is powered from the circuit 55. When the timer is off, the drain from the battery is in the order of 10 micro-amperes and represents only a fifth of the battery capacity over a one-year period.

Flip-flop circuit 55 acts as an electronic switch which is turned on by a contact closure with pin 36 operated by the lock key, and turned off by the timer circuit itself at the end of a timing cycle.

An oscillator/counter integrated circuit 56 is also provided and is controlled by a very stable crystal 57. The counter 56 has fifteen divide-by-two stages and provides outputs at 60, 10 and 1 Hz. The 1 Hz output 58 is used as a clock for the entire circuit and is distributed to integrated circuits U2, U4, U5 and U6. U2 and U3 form an 18- stage counter operated at 1 Hz. On initial power-up, U7A clears U2, U3, U4B, U5A and U5B, and sets U4A. U8 and U9 decode specific times by adding the outputs selected by the dip switches. Timer 53 can thus be adjusted from 1 to 255 seconds in steps of one second, and timer 52 from 32 to 262, 143 seconds (72.8 hours) in steps of 32 seconds. Any gate input not connected to the counter while a switch is open is pulled up to +V by the resistor network 59.

At the expiration of timer 52, U9-9 drops low and sets U4B and U5A thus enabling U8 in preparation for the timing operation of timer 53. On the next positive clock, 0.5 seconds later, U4A is reset. This signals the motor to turn by providing a low on the drive signal to U10. Simultaneously, the counters U2 and U3 are cleared via U7C. Once the counters are cleared, U9-9 returns to a high and 0.5 seconds later, U4A is set. This releases the counters which are now timing the preset time of timer 53. The setting of U4A would normally force the motor back to its original position but U7D and transistors Q1, Q2 insure that the power is only applied to the motor for the duration of the drive signal.

At the expiration of timer 53, U4B is reset. This disables T2 and resets U5A on the next positive clock edge, enabling U7B. This causes the power to be reapplied to the motor via U7D, Q1 and Q2 returning it to its original position. A second later, U6A toggles and removes the power from the timer circuit.

If, during the preset time period of timer 53, the "Open" line is pulled low by the opening of the lock door, U4B is cleared. Again, this disables timer 53 and resets U5A on the next positive clock edge, thus enabling U7B. This causes the power to be applied to the motor via U7D, Q1 and Q2 which returns it to is original position. A second later, U6A toggles and removes the power from the timer circuit.

U10A and U10B are both power amplifiers designed to drive the servo-motor. The feedback potentiometer VR1 is mechanically linked to the output shaft of the motor. It drives the amplifier with a voltage proportional to the shaft's position. When the "Drive" signal is set low by the timer, U10A forces some current to the motor which rotates until the voltage at VR1 reaches a point corresponding to a 90 degree rotation. On the other hand, when the timer sets "Drive" high, U10B forces current in the opposite direction until the voltage at VR1 has returned to its original value. In any event, the power is only applied to the motor and to U10 and VR1 for the duration of half a clock period or 0.5 seconds.

It is within the ambit of the present invention to cover any obvious modifications of the preferred example described herein, provided such modifications fall within the scope of the appended claims. For example, it is pointed out that although the lock cylinder is hereinshown as a key operated cylinder, it is also obvious to a person skilled in the art that this cylinder could be operated by a combination lock using tumblers whereby after a combination is preset, the knob can be positioned in engagement with the shaft 18 of the bolt retracting cam 19.

We claim:

1. A delay action time lock comprising a lock housing having a spring action bolt, a retracting cam having a retracting means for engagement with a bolt retracting lever for retracting a locking end of said bolt in said housing, retracting cam actuating means disposed outside said housing for turning said cam, a motor actuated support cam for normally supporting said bolt retracting lever in a disengaged position with said retracting cam, switch means associated with said retracting cam for enabling a timer circuit to initiate a first preset time delay count, an electric motor connected to said retracting lever support cam, said timer causing said motor to be energized after said preset time delay whereby said motor will turn said support cam in a first direction to cause said retracting lever to move to an engageable position for engagement by said retracting cam, said timer circuit initiating a second preset time delay count after terminating said first count after which said motor is energized to cause said support cam to turn in a reverse direction to support said retracting lever at its disengaged position whether said retracting lever is retracted or not by said retracting cam.

2. A delay action time lock as claimed in claim 1 wherein there is further provided a timer cancellation switch which is actuated by the retraction of said lock bolt by said bolt retracting lever whereby to automatically cancel said second preset time delay count and to cause said motor to be energized and turn said support cam in said reverse direction to place it in a position to support said bolt retracting lever in said disengaged position once said retracting cam is released.

3. A delay action time lock as claimed in claim 2 wherein said retracting means is a hook member formed with said retracting cam, said hook engaging in a retracting notch formed with said bolt retracting lever.

4. A delay action time lock as claimed in claim 3 wherein said switch means comprises a switch contact positioned in the path of said retracting cam hook member so that said hook member abuts said contact when turned by said actuating means to a timer enabling position.

5. A delay action time lock as claimed in claim 4 wherein said retracting cam actuation means comprises hand operable means connectable to said shaft.

6. A delay action time lock as claimed in claim 5 wherein said actuation means is a key cylinder, said cylinder being rotated by a matching key inserted in a key slot of said cylinder, said key constituting said hand operable means

7. A delay action time lock as claimed in claim 3 wherein said bolt retracting cam has a free end provided with a guide edge which is engaged in sliding friction with an end portion of said hook member when displaced thereagainst by rotating said retracting cam, said retracting lever and retracting cam being secured in a common plane.

8. A delay action time lock as claimed in claim 7 wherein a cam engageable member is secured to said retracting lever and disposed for abutting frictional engagement with said motor actuated support cam to displace and support said bolt retracting lever at said disengaged position.

9. A delay action time lock as claimed in claim 8 wherein said cam engageable member is a pin secured to said bolt retracting lever, said pin having a free end disposed in close proximity to a switch contact arm of said timer cancellation switch and engaged therewith in frictional contact to cause said contact arm to effect a switch closure when said bolt retracting lever is retracted by said retracting cam.

10. A delay action time lock as claimed in claim 1 wherein said motor actuated support cam has a peripheral support section for supporting said bolt retraction lever at said disengaged position.

11. A delay action time lock as claimed in claim 10 wherein a cam engageable pin is secured to said bolt retracting lever and extending to one side thereof, said support cam being disc-shaped and disposed to one side of said bolt retracting lever for support engagement of said pin when said support section is displaced thereagainst by rotation of same by said electric motor.

12. A delay action time lock as claimed in claim 1 wherein said timer circuit is an electronic timer having two timer modules for effecting said first and second preset time delay counts, said electronic timer being provided with a plurality of adjustable switches to adjust said time delay counts to desired delays.

* * * * *